US009223334B2

(12) United States Patent
Noda

(10) Patent No.: US 9,223,334 B2
(45) Date of Patent: Dec. 29, 2015

(54) CONSTANT CURRENT CIRCUIT AND LIGHT EMITTING DIODE DRIVING DEVICE USING THE SAME

(75) Inventor: Ippei Noda, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 368 days.

(21) Appl. No.: 13/702,738

(22) PCT Filed: Jun. 16, 2011

(86) PCT No.: PCT/JP2011/064328

§ 371 (c)(1),
(2), (4) Date: Dec. 7, 2012

(87) PCT Pub. No.: WO2012/002235

PCT Pub. Date: Jan. 5, 2012

(65) Prior Publication Data

US 2013/0088157 A1 Apr. 11, 2013

(30) Foreign Application Priority Data

Jun. 29, 2010 (JP) ..... 2010-147982

(51) Int. Cl.
*G05F 3/16* (2006.01)
*G05F 3/24* (2006.01)
*H05B 37/02* (2006.01)

(52) U.S. Cl.
CPC *G05F 3/24* (2013.01); *H05B 37/02* (2013.01); *Y10T 307/593* (2015.04)

(58) Field of Classification Search
CPC ..... H03K 19/018521; H03K 2217/0036; H03K 3/35613; H03K 5/003; H03K 17/04126; H03K 17/16; H03K 3/356017; H03K 5/1536; G05F 3/262; G05F 3/242; G05F 1/575; G05F 1/46; G05F 1/465; G05F 1/56; H05B 33/0818; H05B 33/0815; H05B 33/0827; H05B 37/02; H05B 33/0809
USPC ..... 326/62–63, 68, 80–83, 86–87; 327/108–109, 333, 53, 66, 100, 132, 327/231, 237; 315/209 R, 224, 291, 300, 315/302, 307; 323/212, 312, 315–316
See application file for complete search history.

(56) References Cited

U.S. PATENT DOCUMENTS 7,202,711 B2 * 4/2007 Gose et al. ..... 327/108
7,268,528 B2 9/2007 Noda (Continued)

FOREIGN PATENT DOCUMENTS

| | | |
|---|---|---|
| JP | 9-319323 | 12/1997 |
| JP | 2005-135366 | 5/2005 |
| JP | 2006-109349 | 4/2006 |
| JP | 2007-249384 | 9/2007 |
| JP | 2007-249523 | 9/2007 |

(Continued)

OTHER PUBLICATIONS

International Search Report Issued Sep. 20, 2011 in PCT/JP2011/064328 Filed on Jun. 16, 2011.

*Primary Examiner* — Alexander H Taningco
*Assistant Examiner* — Christopher Lo
(74) *Attorney, Agent, or Firm* — Cooper & Dunham LLP

(57) ABSTRACT

A constant current circuit includes a first transistor, a second transistor having the gate and the source connected to the gate and the source of the first transistor, and having the drain connected to a load, a voltage adjustment circuit section that controls the drain voltage of the first transistor, a constant current generation circuit section that supplies a constant current to the first transistor, and a detection circuit section that determines whether at least one of the first transistor and the second transistor is unable to output a current proportional to the first constant current while at least one of the first transistor and the second transistor operates in the linear region, by performing a voltage comparison between a voltage at a connecting section between the voltage adjustment circuit section and the constant current generation circuit section and a predetermined reference voltage.

18 Claims, 11 Drawing Sheets

(56) References Cited

U.S. PATENT DOCUMENTS

| | | | | |
|---|---|---|---|---|
| 7,463,082 | B2 * | 12/2008 | Chen | 327/543 |
| 7,898,321 | B2 * | 3/2011 | Hayashi | 327/543 |
| 7,956,676 | B2 | 6/2011 | Noda | |
| 2008/0036442 | A1 | 2/2008 | Noda | |
| 2008/0061745 | A1 | 3/2008 | Noda | |
| 2008/0174253 | A1 * | 7/2008 | Noda | 315/291 |
| 2008/0224632 | A1 * | 9/2008 | Noda | 315/291 |
| 2009/0224804 | A1 | 9/2009 | Noda | |
| 2011/0043955 | A1 | 2/2011 | Noda | |

FOREIGN PATENT DOCUMENTS

| | | |
|---|---|---|
| JP | 2008-17616 | 1/2008 |
| JP | 2008-67188 | 3/2008 |
| JP | 2008-177330 | 7/2008 |
| JP | 2008-227213 | 9/2008 |
| JP | 2009-44297 | 2/2009 |
| JP | 2011-45157 | 3/2011 |
| JP | 2012-14264 | 1/2012 |
| WO | 2012/002235 A1 | 1/2011 |

* cited by examiner

CONSTANT CURRENT CIRCUIT AND LIGHT EMITTING DIODE DRIVING DEVICE USING THE SAME

TECHNICAL FIELD

The present invention relates to a constant current circuit, and more particularly to a constant current circuit for driving, for example, a light emitting diode (LED) and a light emitting diode driving device using the constant current circuit.

BACKGROUND ART

Generally, light emitting diodes (LEDs) for display devices are driven using a constant current to reduce the dispersion of the luminance of the LEDs. When the luminance is adjusted in accordance with the application of the light emitting diode, the current setting of the constant current circuit is changed. However, the voltage drop of the light emitting diode varies depending on the driving current. Because of this feature, the voltage at the output terminal (i.e., the voltage at the output terminal of the constant current circuit) may greatly vary.

Generally, in the constant current circuit, the drain electrode of a MOS transistor is used as the output terminal. However, in this case, there is a problem that when the voltage at the output terminal greatly changes, due to the channel length modulation effect of the MOS transistor, the output current may change and as a result, the luminance of the light emitting diode may change.

To solve the problem, there is a constant current circuit as illustrated in FIG. 9.

In FIG. 9, the NMOS transistors M111, M112, M141, and M142 constitute a low-voltage cascode-type current mirror circuit. Further, the output current iout is supplied to an external load 110 which is connected to an output terminal OUT. The output current iout is obtained by multiplying a current iref by a ratio determined based on the transistor size ratio between the NMOS transistor M111 and the NMOS transistor M112. An error amplification circuit OP102 controls an NMOS transistor M116 so that a voltage of a connection part between a resistor R111 and the NMOS transistor M116 is equal to a reference voltage Vref. In this case, when the resistance value of the resistor R111 is r111, a current iref2 flowing through the resistor R111 is obtained by the formula iref2=Vref/r111. The current iref2 is reflected by PMOS transistors M115 and M114 to become a current iref1, the PMOS transistors M115 and M114 constituting a current mirror circuit.

The NMOS transistors M111, M112, M141, and M142 constituting an output circuit to supply a current to the external load 110 form a cascode-type current mirror circuit. Therefore, the drain voltage of the NMOS transistor M112 becomes equivalent to the drain voltage of the NMOS transistor M111 regardless of the voltage at the output terminal OUT. As a result, the voltage change at the output terminal OUT has a small effect on the output current iout.

However, in a case where an output transistor to supply current to the output terminal OUT is constituted by the NMOS transistors M112 and M142 which are connected in series, even when the output circuit is constituted by the low-voltage cascode-type current mirror circuit, the voltage at the output terminal OUT may be increased. The voltage is necessary for the output transistor to operate in the saturation region where constant current accuracy can be maintained.

For example, when the NMOS transistors M111, M112, M141, M142 are the same conductivity-type transistors and have the same transistor size and the threshold voltage, the gate-source voltage, and the overdrive voltage are denoted by Vthn, Vgs2, and Vov, respectively, the following formula (a) is obtained.

$$Vds1=Vbias-Vgs2 \quad (a)$$

When the bias voltage Vbias is set to be Vbias=Vgs2+Vov so that the NMOS transistor M112 can operate at the boundary between the linear region and the saturation region, the above formula (a) is changed to the following formula (b).

$$Vds1=Vov \quad (b)$$

Similar to the NMOS transistor M112, when the NMOS transistor M142 also operates at the boundary between the linear region and the saturation region, the drain-source voltage Vds2 of the NMOS transistor M142 is expressed by the following formula (c).

$$Vds2=Vov \quad (c)$$

Therefore, the minimum voltage Vomin at the output terminal OUT is expressed by the following formula (d).

$$Vomin=Vds1+Vds2=2\times Vov \quad (d)$$

In a general CMOS process, the minimum voltage Vomin is in a range from 0.6 V to 1.0 V. When the voltage at the output terminal OUT is high, the power consumption consumed by the output transistor of the constant current circuit becomes large. Further, in order to output a large current to drive a light emitting diode, the output transistor having a very large size is required to be used. Because of this feature, when two MOS transistors connected in series are used to constitute the output transistor, the chip area may be greatly increased.

Further, the drain-source voltage of the NMOS transistor M142 greatly varies depending on the voltage at the output terminal OUT. On the other hand, the drain-source voltage of the NMOS transistor M141 becomes equal to a value of (Vthn+Vov)−Vov=Vthn. However, the drain-source voltage of the NMOS transistor M141 differs from the drain-source voltage of the NMOS transistor M142. Namely, the drain-source voltage of the NMOS transistor M111 differs from the drain-source voltage of the NMOS transistor M112. As a result, a systematic error may be generated in the output current iout.

To solve such a problem, as illustrated in FIG. 10, there is the constant current circuit where even when the external load changes, the external load being connected to the output terminal of the constant current circuit, the output current does not change, and even when the voltage at the output terminal is low, the constant current circuit stably operates in the saturation region (see, for example, Patent Document 1).

In this case, when a variable resistor R is appropriately adjusted, the drain-source voltage of the NMOS transistor NT1 is equal to the drain-source voltage of the NMOS transistor NT2 without using the cascade-type current mirror circuit. Therefore, a constant current can be accurately output without generating the systematic error.

However, the drain voltage of the NMOS transistor NT2 can be adjusted only in a range from a voltage where the NMOS transistor NT2 operates in the saturation region to the gate-source voltage of the NMOS transistor NT2. Namely, a range of the voltage Vo at the output terminal OUT where the constant current can output without generating the systematic error is expressed as Vov2≤Vo≤Vthn+Vov2, where Vthn and Vov2 denote the threshold voltage and the overdrive voltage, respectively, of the NMOS transistor NT2. Therefore, there is a problem that a variable range of the voltage Vo at the output terminal OUT may be largely limited.

To resolve such a problem, there is a constant current circuit as illustrated in FIG. 11 (see, for example Patent Document 2).

In FIG. 11, the output terminal voltage range where the accuracy of the output current can be maintained can be expanded by level-shifting and feedbacking the output terminal voltage to the current mirror circuit.

[Patent Document 1] Japanese Laid-Open Patent Application No. 09-319323

[Patent Document 2] Japanese Laid-Open Patent Application No. 2008-227213

DISCLOSURE OF THE INVENTION

Problems to be Solved by the Invention

On the other hand, in a state where the voltage supplied to the anode terminal of a light emitting diode is lowered and the constant current circuit is unable to output a predetermined current, it is necessary to detect this state and to adjust the voltage supplied to the anode terminal of the light emitting diode.

However, in the constant current circuit illustrated in FIG. 11, the minimum voltage where the output transistor operates in the saturation region is detected. Therefore, the voltage supplied to the anode terminal of the light emitting diode is adjusted before the constant current circuit becomes unable to output the predetermined current. As a result, the efficiency is bad.

The present invention is made in light of the above circumstances, and may provide a constant current circuit and a light emitting diode driving device using the constant current circuit that substantially expands the operating voltage range at the output terminal where highly-accurate output current is output and that improves the efficiency as well.

Means for Solving the Problems

According to an aspect of the present invention, there is provided a constant current circuit generating a predetermined constant current and supplies the constant current to a load. The constant current circuit includes a first transistor composed of a MOS transistor that flows a current in accordance with a control signal input to the gate of the first transistor, a second transistor composed of a MOS transistor having a same conductivity type as that of the first transistor, the gate and the source of the second transistor corresponding to and being connected to the gate and the source, respectively, of the first transistor, the drain of the second transistor being connected to the load, the second transistor supplying a current to the load, the current being in accordance with the control signal input to the gate of the second transistor, and a voltage adjustment circuit section that controls the drain voltage of the first transistor in accordance with the drain voltage of the second transistor. The constant current circuit further includes a constant current generation circuit section that is composed of a first current source that supplies a predetermined first constant current to the first transistor via the voltage adjustment circuit section, a level shift circuit section that level-shifts a voltage of a connecting section between the voltage adjustment circuit section and the constant current generation circuit section and that outputs the level-shifted voltage to the gates of the first transistor and the second transistor, and a detection circuit section that determines whether at least one of the first transistor and the second transistor is unable to output a current proportional to the first constant current while at least one of the first transistor and the second transistor operates in the linear region. Further, the detection circuit section determines by performing a voltage comparison between a voltage at a connecting section between the voltage adjustment circuit section and the constant current generation circuit section and a predetermined reference voltage.

Specifically, the detection circuit section generates a fourth constant current having a same current value as that of the first constant current, supplies the fourth constant current to a sixth transistor having a same conductivity type as that of the first transistor, and sets a voltage of the input terminal of the sixth transistor as the reference voltage. The voltage is obtained by level-shifting a voltage of the input terminal of the sixth transistor, the fourth constant current being input to the input terminal, and inputting the level-shifted voltage to the gate of the sixth transistor.

Further, the level shift circuit section includes a third transistor composed of a MOS transistor and having a gate connected to a connecting section between the voltage adjustment circuit section and the constant current generation circuit section and a second constant current source that supplies a predetermined second constant current to the third transistor. The third transistor and the second constant current source form a source follower circuit, and a connecting section between the third transistor and the second constant current source is connected to the gates of the first transistor and the second transistor, so that the level shift circuit section level-shifts the voltage of the connecting section between the voltage adjustment circuit section and the constant current generation circuit section by the gate-source voltage of the third transistor.

In this case, the detection circuit section includes the sixth transistor composed of a MOS transistor that flows a current in accordance with a control signal input to the gate of the sixth transistor, a fourth current source that supplies a predetermined fourth constant current to the sixth transistor, a level shift circuit that level-shifts a voltage of a connecting section between the sixth transistor and the fourth current source and outputs the level-shifted voltage to the gate of the sixth transistor, and a voltage comparison circuit that performs a voltage comparison between the reference voltage and the voltage of the connecting section between the voltage adjustment circuit section and the constant current generation circuit section. Further, the reference voltage is the voltage of the connecting section between the sixth transistor and the fourth current source, and generates and outputs a signal indicating a result of the voltage comparison.

Specifically, the level shift circuit includes a seventh transistor that has the gate connected to a connecting section between the sixth transistor and the fourth current source and that is composed of a MOS transistor having a same conductivity type as that of the third transistor, and a fifth constant current source that supplies a predetermined fifth constant current to the seventh transistor. Further, the seventh transistor and the fifth constant current source form a source follower circuit. A connecting section between the seventh transistor and the fifth constant current source is connected to the gate of the sixth transistor, so that the level shift circuit level-shifts the voltage of the connecting section between the seventh transistor and the fifth constant current source by the gate-source voltage of the seventh transistor.

Further, a current amplification factor of the seventh transistor may be less than the current amplification factor of the third transistor.

Further, a threshold value of the seventh transistor may be greater than the threshold value of the third transistor.

Further, the fifth constant current source generates the fifth constant current having a current value greater than the current value of the second constant current.

Further, the voltage adjustment circuit section includes a fourth transistor that is connected between the constant current generation circuit section and the first transistor and that is composed of a MOS transistor, a fifth transistor having a terminal connected to the drain of the second transistor, having the gate connected to the gate of the fourth transistor, and composed of a MOS transistor having a same conductivity type as that of the fourth transistor, and a third constant current source that supplies a predetermined third constant current to the other terminal of the fifth transistor. A connecting section between the gates of the fourth transistor and the fifth transistor is connected to a connecting section between the third constant current source and the fifth transistor. An operation of the fourth transistor is controlled so that the drain voltage of the first transistor is equal to the drain voltage of the second transistor.

In this case, the first constant current and the third constant current are set in a manner such that a value of a current ratio between the first constant current and the third constant current is equal to a value of a ratio between a current amplification degree of the fourth transistor and the current amplification degree of the fifth transistor.

Further, the fourth transistor has a same conductivity type and a same size as those of the first transistor.

Further, the voltage adjustment circuit section may include a fourth transistor that is connected between the constant current generation circuit section and the first transistor and that is composed of a MOS transistor, a voltage generation circuit that generates a voltage obtained by adding a predetermined voltage to the drain voltage of the second transistor, a fifth transistor having a terminal to which the voltage generated by the voltage generation circuit is input, having the gate connected to the gate of the fourth transistor, and composed of a MOS transistor having a same conductivity type as that of the fourth transistor, and a third constant current source that supplies a predetermined third constant current to the other terminal of the fifth transistor. Further, a connecting section between the gates of the fourth transistor and the fifth transistor may be connected to a connecting section which is defined between the third constant current source and the fifth transistor. Also, an operation of the fourth transistor may be controlled so that the drain voltage of the first transistor is greater than the drain voltage of the second transistor by the predetermined voltage.

Further, the voltage adjustment circuit section may include a fourth transistor that is connected between the constant current generation circuit section and the first transistor and that is composed of a MOS transistor, a fifth transistor having a terminal connected to the drain of the second transistor, having the gate connected to the gate of the fourth transistor, and composed of a MOS transistor having a same conductivity type as that of the fourth transistor, and a third constant current source that supplies a predetermined third constant current to the other terminal of the fifth transistor. Further, a connecting section which is defined between the gates of the fourth transistor and the fifth transistor may be connected to a connecting section between the third constant current source and the fifth transistor. An operation of the fourth transistor may be controlled so that the drain voltage of the first transistor is greater than the drain voltage of the second transistor by a predetermined voltage.

Further, the voltage adjustment circuit section may include a comparison circuit that performs a voltage comparison between the drain voltage of the first transistor and the drain voltage of the second transistor and that generates and outputs a signal indicating a result of the voltage comparison, and a voltage adjustment circuit that controls the drain voltage of the first transistor in accordance with the drain voltage of the second transistor based on the signal indicating the result of the voltage comparison. Further, the comparison circuit may be composed of an error amplification circuit having input terminals to which the respective drain voltages of the first transistor and the second transistor are input. The voltage adjustment circuit may have the gate to which the output signal from the error amplification circuit is input and may be is composed of a fourth transistor that is connected to the drain of the first transistor in series and that is composed of a MOS transistor.

In this case, the fourth transistor may be a transistor having a same conductivity type as that of the first transistor, and the error amplification circuit may control an operation of the fourth transistor so that the drain voltage of the first transistor is equal to the drain voltage of the second transistor.

Further, the fourth transistor may be a transistor having a same conductivity type as that of the first transistor, and the error amplification circuit may provide a predetermined input offset voltage so that the drain voltage of the first transistor is greater than the drain voltage of the second transistor by a predetermined voltage.

Further, the voltage adjustment circuit section may further include a capacitor connected between a connecting section and the gate of the fourth transistor. The connecting section is defined between the fourth transistor and the constant current generation circuit section.

Further, the first transistor, the second transistor, the voltage adjustment circuit section, the constant current generation circuit section, the level shift circuit section, and the detection circuit section may be integrated into a single IC.

Further, a light emitting diode driving device according to an aspect of the present invention includes any one of the above constant current circuits that generates a predetermined constant current and supplies the generated current to a light emitting diode.

Effects of the Present Invention

According to an embodiment of the present invention, by having the detection circuit section that determines whether at least one of the first transistor and the second transistor is unable to output a current proportional to the first constant current while at least one of the first transistor and the second transistor operates in the linear region, it may become possible to substantially expand the voltage range at the output terminal where highly-accurate output current can be output, greatly improve the efficiency, and obtain far greater versatility.

Further, it may become possible to greatly reduce the chip area and output a highly-accurate constant current without depending on the terminal voltage which is the voltage of the connecting section to the load. Further, it may become possible to reduce the terminal voltage without degrading the constant current output accuracy and greatly reduce the power consumption.

DESCRIPTION OF THE REFERENCE NUMERALS

1: CONSTANT CURRENT CIRCUIT
2, 11, 15-17: CONSTANT CURRENT SOURCE
3: LEVEL SHIFT CIRCUIT
4: VOLTAGE ADJUSTMENT CIRCUIT
5: DETECTION CIRCUIT
10: EXTERNAL LOAD
21: OFFSET VOLTAGE GENERATION CIRCUIT
OP1, 27: ERROR AMPLIFICATION CIRCUIT
M1, M2, M13-M17: NMOS TRANSISTOR
M21: PROS TRANSISTOR
C11: CAPACITOR

BEST MODE FOR CARRYING OUT THE INVENTION

Next, the present invention is described in detail based on embodiments of the present invention with reference to the accompanying drawings.

First Embodiment

Figure 1:
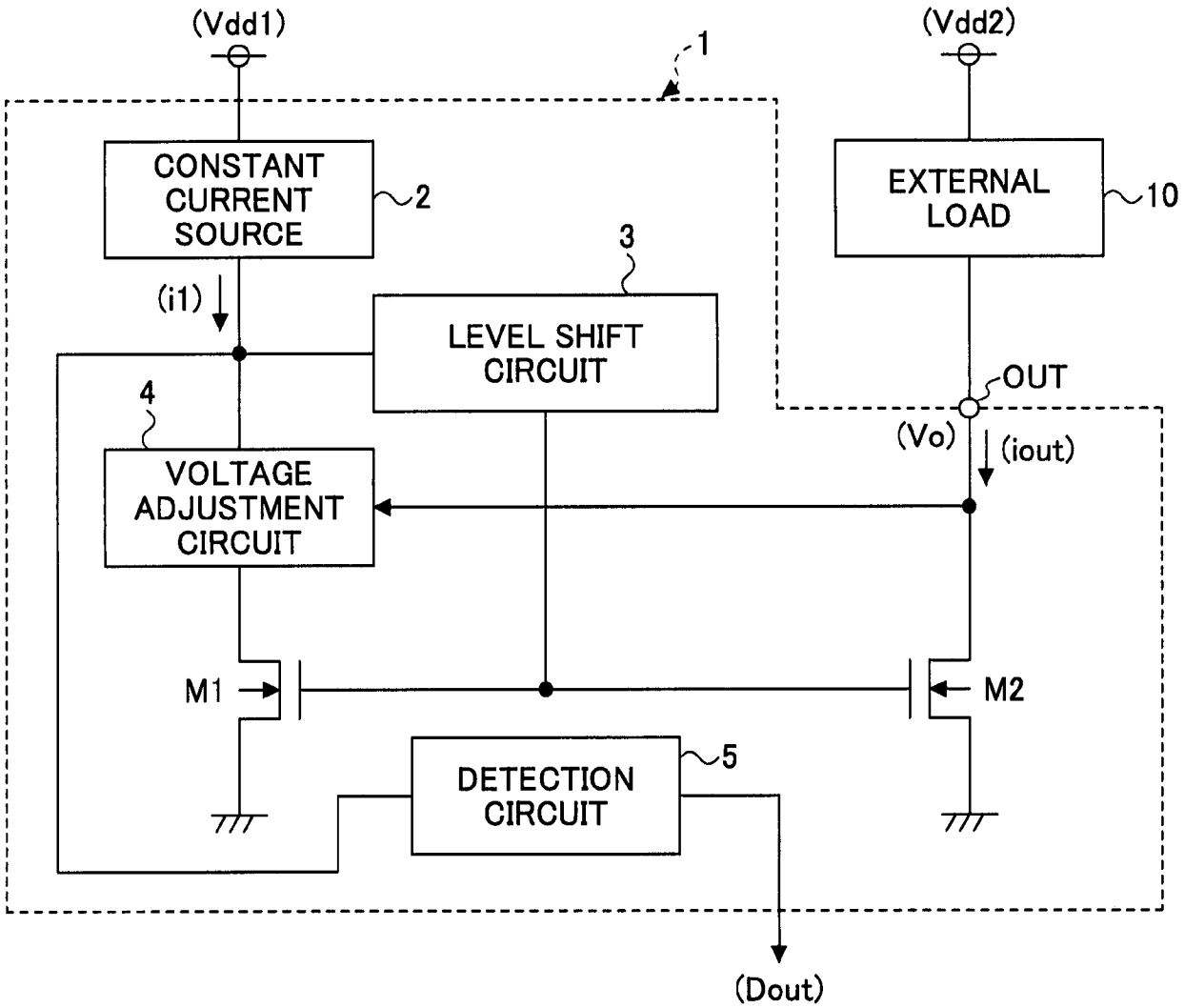
FIG. 1 is a block diagram illustrating an exemplary configuration of a constant current circuit according to a first embodiment of the present invention.

FIG. 1 is a block diagram illustrating an exemplary configuration of a constant current circuit according to a first embodiment of the present invention.

A constant current circuit 1 of FIG. 1 generates a predetermined constant current and supplies the constant current to an external load 10 such as a light emitting diode via the output terminal OUT. Further, the constant current circuit 1 includes NMOS transistors M1 and M2, a constant current source 2 generating and outputting a predetermined constant current, a level shift circuit 3, a voltage adjustment circuit 4, and a detection circuit 5. In FIG. 1, the external load 10 is a light emitting diode. When the constant current circuit 1 constitutes a light emitting diode driving device, the anode and the cathode of the light emitting diode are connected to a power-supply voltage Vdd2 and an output terminal OUT, respectively.

The external load 10 is connected between the power-supply voltage Vdd2 and the output terminal OUT. The drain of the NMOS transistor M2 is connected to the output terminal OUT. The sources of the NMOS transistors M1 and M2 are connected to the ground voltage, respectively. The gates of the NMOS transistors M1 and M2 are connected to each other, and the voltage of the connecting section of the NMOS transistors M1 and M2 is controlled by the level shift circuit 3 as shown. A current supplied from the constant current source 2 using a power-supply voltage Vdd1 as a power-supply source is input into the drain of the NMOS transistor M1 via the voltage adjustment circuit 4.

The voltage adjustment circuit 4 adjusts the drain voltage of the NMOS transistor M1 in accordance with the drain voltage of the NMOS transistor M2, so that the drain voltage of the NMOS transistor M1 is equal to the drain voltage of the NMOS transistor M2. Further, the level shift circuit 3 controls the gate voltages of the NMOS transistors M1 and M2 so as to level-shift (change) the voltage of the connecting section between the constant current source 2 and the voltage adjustment circuit 4 by a predetermined voltage. Namely, the level shift circuit 3 outputs the voltage to the gates of the NMOS transistors M1 and M2, the voltage being obtained by level-shifting (changing) the voltage of the connecting section between the constant current source 2 and the voltage adjustment circuit 4 by the predetermined voltage.

The detection circuit 5 detects a state that while at least one of the NMOS transistors M1 and M2 operates in the linear region, at least one of the NMOS transistors M1 and M2 becomes unable to output a current proportional to a constant current i1 from the constant current source 2.

Figure 2:
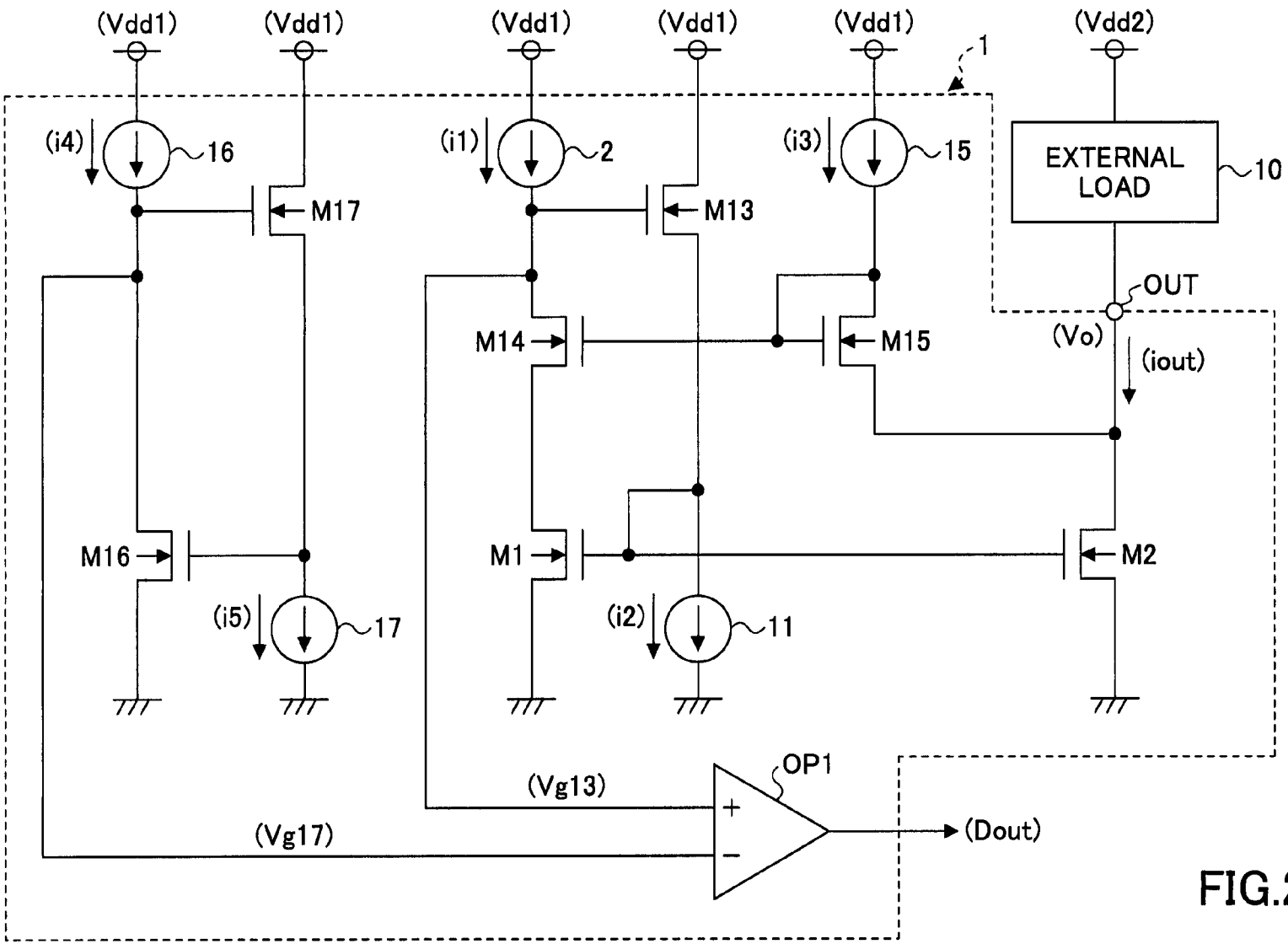
FIG. 2 is a drawing illustrating an example of the constant current circuit 1 of FIG. 1.

FIG. 2 illustrates an example circuit of the constant current circuit 1.

In FIG. 2, the level shift circuit 3 is constituted by an NMOS transistor M13 and a constant current source 11 supplying a predetermined constant current i2. The voltage adjustment circuit 4 is constituted by NMOS transistors M14 and M15 and a constant current source 15 supplying a predetermined constant current i3. Further, the detection circuit 5 is constituted by NMOS transistors M16 and M17, an error amplification circuit OP1, and constant current sources 16 and 17 supplying predetermined constant currents i4 and i5, respectively.

The constant current source 2 and the NMOS transistor M14 are connected in series between the power-supply voltage Vdd1 and the drain of the NMOS transistor M1. The connecting section between the constant current source 2 and the NMOS transistor M14 is connected to the gate of the NMOS transistor M13.

Further, the NMOS transistor M13 and the constant current source 11 are connected in series between the power-supply voltage Vdd1 and the ground voltage. The connecting section between the NMOS transistor M13 and the constant current source 11 is connected to each of the gates of the NMOS transistors M1 and M2. Further, the constant current source 15 and the NMOS transistor M15 are connected in series between the power-supply voltage Vdd1 and the drain of the NMOS transistor M2. The gate of the NMOS transistor M14 is connected to the gate of the NMOS transistor M15, the connecting section between the gates of the NMOS transistors M14 and M15 is connected to the drain of the NMOS transistor M15.

The constant current source 16 and the NMOS transistor M16 are connected in series between the power-supply voltage Vdd1 and the ground voltage. The connecting section between the constant current source 16 and the NMOS transistor M16 is connected to the gate of the NMOS transistors M17 and the inverting input terminal of the error amplification circuit OP1. Further, the NMOS transistor M17 and the constant current source 17 are connected in series between the power-supply voltage Vdd1 and the ground voltage. The connecting section between the NMOS transistor M17 and the constant current source 17 is connected to the gate of the NMOS transistor M16. The not-inverting input terminal of the error amplification circuit OP1 is connected to the connecting section between the constant current source 2 and the NMOS transistor M14.

Further, the NMOS transistors M1 and M2 refer to the first and the second transistors, respectively. The constant current source 2 and the level shift circuit 3 refer to a first constant current source and a level shift circuit section, respectively. The voltage adjustment circuit 4 and the detection circuit 5 refer to a voltage adjustment circuit section and a detection circuit section, respectively. Further, the NMOS transistors M13, M14, M15, M16, and M17 refer to third, fourth, fifth, sixth, and seventh transistors, respectively. The constant current sources 11, 15, 16, and 17 refer to second, third fourth, and fifth constant current sources, respectively. Further, the error amplification circuit OP1 refer to a voltage comparison circuit. The constant current circuit 1 may be integrated into a single integrated circuit (IC).

In such a configuration, the NMOS transistor M13 and the constant current circuit 11 form a source follower circuit, and a voltage is output to the gates of the NMOS transistors M1 and M2, the voltage being obtained by level-shifting the drain voltage of the NMOS transistor M14 (i.e., the voltage of the connecting section between the constant current circuit 2 and the NMOS transistor M14) by the gate-source voltage of the NMOS transistor M13.

In the following, the gate-source voltages of the NMOS transistors M1, M2, M13, M14, and M15 are denoted by Vgs1, Vgs2, Vgs13, Vgs14, and Vgs15, respectively. Further, the drain-source voltages of the NMOS transistors M1 and M2 are denoted by Vds1 and Vds2, respectively.

Since the source voltage of the NMOS transistor M15 is equal to the drain voltage of the NMOS transistor M2, the gate voltage Vg15 of the NMOS transistor M15 is given as in the following formula (1).

$$Vg15=Vds2+Vgs15 \quad (1)$$

Since the gates of the NMOS transistors M14 and M15 are connected to each other, the drain voltage Vd1 of the NMOS transistor M1 is equal to a voltage which is obtained by subtracting the gate-source voltage Vgs14 of the NMOS transistor M14 from the gate voltage Vg15 of the NMOS transistor M15. Therefore, the following formula (2) is obtained from the above formula (1)

$$Vd1=Vg15-Vgs14=(Vds2+Vgs15)-Vgs14 \quad (2)$$

When it is assumed that the conductivity type of the NMOS transistors M14 and M15 are the same as each other and the threshold value voltage (threshold value) Vthn of the NMOS transistors M14 and M15 are the same as each other and that the current amplification degree β of the NMOS transistors M14 and M15 are denoted by β14 and β15, respectively, the constant currents i1 and i3 are given by the following formulas (3) and (4), respectively.

$$i1=\beta 14\times(Vgs14-Vthn)^2 \quad (3)$$

$$i3=\beta 15\times(Vgs15-Vthn)^2 \quad (4)$$

Based on the above, the following formula (5) is satisfied.

$$i1/i3=\beta 14/\beta 15\times(Vgs14-Vthn)^2/(Vgs15-Vthn)^2 \quad (5)$$

According to formula (5), by satisfying the following formula (6), due to the formula (2), Vd1=Vd2 is satisfied.

$$i1/\beta 14=i3/\beta 15 \quad (6)$$

Therefore, by setting the transistor size of the NMOS transistors M14 and M15 and the constant currents i1 and i3 so as to satisfy the formula (6), the gate voltage, the drain voltage, and the source voltage of the NMOS transistor M1 are equal to the gate voltage, the drain voltage, and the source voltage of the NMOS transistor M2, respectively. As a result, the NMOS transistor M2 may accurately output a current determined in accordance with the transistor size ratio between the NMOS transistors M1 and M2 without suffering an influence of λ characteristics.

Further, regarding the drain voltage Vd14 of the NMOS transistor 14, the formula Vd14=Vgs1+Vgs13 is satisfied. When the drain-source voltage of the NMOS transistor M14 is denoted by Vds14, the formula Vd1+Vds14=Vd14=Vgs1+Vgs13 is satisfied. Further, according to Vd1=Vd2, the following formula (7) is obtained.

$$Vds14=Vgs1+Vgs13-Vd2 \quad (7)$$

When the overdrive voltage of the NMOS transistor M14 is denoted by Vov14, in order for the NMOS transistor M14 to operate at the saturation region, it is necessary to satisfy Vds14≥Vov14. Therefore, according to the formula (7), the formula Vgs1+Vgs13−Vd2≥Vov14 is obtained.

In this case, when it is assumed that the conductivity type of the NMOS transistors M1 and M14 are the same and the NMOS transistors M1 and M14 have the same size and that the threshold value voltage and the overdrive voltage of the NMOS transistor M1 are denoted by Vthn and Vov1, respectively, Vthn+Vov1+Vgs13−Vd2≥Vov14 is obtained.

Since Vov1=Vov14, Vthn+Vgs13−Vd2≥0, that is, Vthn+Vgs13≥Vd2 is obtained.

Further, when the threshold value voltage and the overdrive voltage of the NMOS transistor M13 are denoted by Vthn and Vov13, respectively, Vthn+(Vov1+Vgs13)≥Vd2 is obtained and further, the following formula (8) is obtained.

$$Vds2=Vd2\leq Vthn\times 2+Vov13 \quad (8)$$

The threshold value voltage Vthn is a parameter determined based on the manufacturing process, and the overdrive voltage Vov13 may be arbitrarily set based on the transistor size of the NMOS transistor M13 and the current i2 flowing through the NMOS transistor M13. Therefore, the operating voltage of the circuit may be determined in conformity with the change of the drain voltage Vd2 of the NMOS transistor M2.

Next, the minimum drain voltage so that the NMOS transistor M2 operates in the saturation region is considered.

When the threshold value voltage and the overdrive voltage of the NMOS transistor M2 are denoted by Vthn and Vov2, respectively, the conditions for the NMOS transistor M2 to operate in the saturation region are described in the following formula (9).

$$Vds2\geq Vgs2-Vthn=Vov2 \quad (9)$$

Based on this formula (9), the minimum voltage of the voltage Vo at the output terminal OUT is Vov2. Therefore, the minimum voltage may be reduced by half when compared with related art.

For example, when it is assumed that Vthn=0.8 V, Vov2=0.3 V, and Vov13=0.3 V, according to the above formula (8), the control conditions where the drain voltage of the NMOS transistor M11 is equal to the dratin voltage of the NMOS transistor M12 are Vds2≤1.9 V. Further, according to the above formula (9), the conditions where the NMOS transistor M2 operates in the saturation region are Vds2≥0.3 V.

Namely, the output current accuracy may be maintained in the following range (10).

$$0.3\ V\leq Vds2\leq 1.9\ V \quad (10)$$

In this case, when the voltage Vo at the output terminal OUT is lowered to less than 0.3 V and the NMOS transistor M2 goes into the linear region, due to the relationship Vd1=Vd2 derived from the formulas (2) through (6), the NMOS transistor M1 also goes into the linear region. Further, since the gate voltage of the NMOS transistor M1 is controlled so that the constant current i1 flows through the NMOS transistor M1, when the NMOS transistor M1 goes into the linear region, the gate voltage Vg1 of the NMOS transistor M1 is increased and the gate voltage of the NMOS transistor M13 is also increased. In this case, according to the formula (7), it is apparent that the NMOS transistor M14 operates in the saturation region. Therefore, in this case, if the NMOS transistor M13 operates in the saturation region and the constant current source 2 outputs a predetermined constant current i1, the NMOS transistors M1 and M2 may output the respective predetermined currents.

Figure 3:
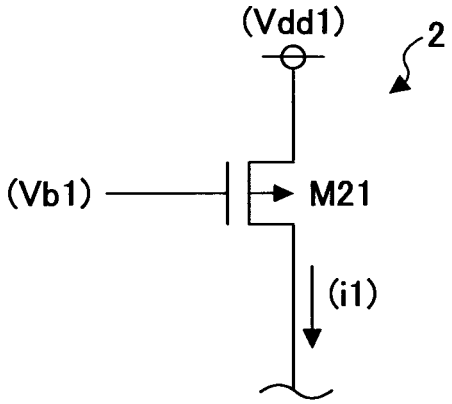
FIG. 3 is a drawing illustrating an example of the constant current source 2 of FIG. 1.

As illustrated in FIG. 3, the constant current source 2 is constituted by a PMOS transistor M21. Since a predetermined bias voltage Vb1 is input to the gate of the PMOS transistor M21, the PMOS transistor M21 outputs the constant current i1 which corresponds to a predetermined reference current from the drain.

When the gate-source voltage, the drain-source voltage, the threshold value voltage, and the overdrive voltage of the PMOS transistor M21 are denoted by Vgs21, Vds21, Vthp, and Vov21, respectively, the conditions for the PMOS transistor M21 to operate in the saturation region are express in the following formula (11)

$$Vds21 \geq Vgs21 - Vthp = Vov21 \quad (11)$$

When it is assumed that the power-supply voltage of the constant current circuit 1 is denoted by Vdd1 and the gate voltage of the NMOS transistor M13 is denoted by Vg13, according to the formula (11), the following formula (12) is to be satisfied.

$$Vdd1 + Vov21 \geq Vg13 = Vgs13 + Vgs1 \quad (12)$$

Next, the operations of the NMOS transistors M16 and M17 and the constant current sources 16 and 17 included in the detection circuit 5 are described.

It is assumed that the conductivity type of the NMOS transistor M16 is the same as that of the NMOS transistor M1 and that the current amplification degree β of the NMOS transistor M16 is the same as that of the NMOS transistor M1. Further, it is assumed that the constant current sources 16 outputs the current same as the constant current i1 and is constituted by a PMOS transistor having the same conductivity type and the same current amplification degree β as those of the PMOS transistor M21 of FIG. 3.

When the gate-source voltage of the NMOS transistor M16 and the gate-source voltage of the NMOS transistor M17 are denoted by Vgs16 and Vgs17, respectively, the gate voltage Vg17 of the NMOS transistor M17 is expressed as follows:

$$Vg17 = Vgs17 + Vgs16$$

Since the constant current source 16 outputs a current same as the constant current i1 and is constituted by the PMOS transistor having the same conductivity type and the same current amplification degree β as those of the PMOS transistor M21 of FIG. 3, the conditions for the PMOS transistor consituting the constant current source 16 to operate in the saturation region are expressed in the following formula (13).

$$Vdd1 + Vov21 \geq Vg17 = Vgs17 + Vgs16 \quad (13)$$

According to the formulas (12) and (13), by satisfying the following formula (14), the constant current source 2 may output the predetermined constant current i1.

$$Vdd1 + Vov21 \geq Vgs17 + Vgs16 \geq Vgs13 + Vgs1 \quad (14)$$

Further, when the drain-source voltage Vds13 of the NMOS transistor M13 satisfies the following formula (15), the NMOS transistor M13 may operation in the saturation region.

$$Vds13 = Vdd1 - Vgs1 \geq Vgg13 - Vthn \quad (15)$$

Therefore, when the above formulas (14) and (15) are satisfied, the NMOS transistors M1 and M2 may output the respective predetermined currents.

For example, in a case where the constant currant circuit 1 drives a light emitting diode for a display of a mobile device which is driven by a lithium-ion battery, the power-supply voltage Vdd1 corresponds to the battery voltage of the lithium-ion battery. Therefore, generally, based on the discharge curve of the lithium-ion battery, it is preferable to assume that 3.2 V≥Vdd1≥4.4 V and that for the consideration of the above formulas (14) and (15), it is determined that Vdd1=3.2 V.

As described above, Vthn=0.8 V. When assuming that Vov21=−0.3 V, and Vov16=0.3 V, the first and the second members of the above formula (14) are expressed as follows:

$$Vdd1 + Vov21 = 3.2\ V - 0.3\ V = 2.9\ V \geq Vgs17 + Vgs16$$

Since Vgs16=(0.8 V+0.3 V)=1.1 V, the following relation is obtained.

$$Vdd1 + Vov21 = 3.2\ V - 0.3\ V = 2.9\ V \geq Vgs17 + 1.1\ V$$

Therefore, the above formula (14) becomes the following formula (16).

$$2.9\ V \geq Vgs17 + 1.1\ V \geq Vgs13 + Vgs1 \quad (16)$$

In the NMOS transistor M17, the threshold value voltage and the overdrive voltage are denoted by Vthn17 and Vov17, respectively.

In this case, it may be easy to set the threshold value voltage Vthn17 of the NMOS transistor M17 to be greater than Vthn by, for example, changing the manufacturing process or applying the back bias effect. When assuming that Vthn17=1.0 V and Vov17=0.3 V, Vgs17=Vthn17+Vov17=1.0 V+0.3 V=1.3 V is obtained. Therefore, the above formula (16) is expressed in the following formula (17).

$$2.9\ V \geq Vgs17 + 1.1\ V = 2.4\ V \geq Vgs13 + Vgs1 \quad (17)$$

Further, as described above, since Vov13=0.3 V, Vgs13=Vthn+Vov13=0.8 V+0.3 V=1.1 V. Therefore, the above formula (17) is expressed as 2.9V≥Vgs17+1.1 V=2.4 V≥1.1 V+Vgs1. When 1.1 V is subtracted from each member of the formula, the following formula (18) is obtained, which shows the correct magnitude relationship between the first member and the second member of the formula (18).

$$1.8\ V \geq 1.3\ V \geq Vgs1 \quad (18)$$

Next, the operations of the detection circuit 5 are described.

The voltage Vg13 and the voltage Vg17 are input into the input terminals of the error amplification circuit OP1. The voltage Vg13 is the voltage of the connecting section between the constant current source 2 and the NMOS transistor M14, and the voltage Vg17 is the voltage of the connecting section between the constant current source 16 and the NMOS transistor M16. The error amplification circuit OP1 outputs a low-level signal Dout when the voltage Vg13 is less than the voltage Vg17, and outputs a high-level signal Dout when the voltage Vg13 is equal to or greater than the voltage Vg17.

Namely, the error amplification circuit OP1 outputs the low-level signal Dout when the voltage Vo at the output terminal OUT of the constant current circuit 1 is sufficiently high and a predetermined current is being output from the output terminal OUT. On the other hand, the error amplification circuit OP1 outputs the high-level signal pout when the voltage Vo at the output terminal OUT of the constant current circuit 1 is lowered. The NMOS transistors M1 and M2 operate in the respective linear regions. The voltage Vg13 becomes equal to or greater than the voltage Vg17. Because of this feature, by using the signal Dout, for example, it may become possible to increase the voltage of the anode of a light emitting diode which constitutes the external load 10, so that the constant current circuit 1 may output a predetermined current.

Generally, to the anode of the light emitting diode, a voltage is externally supplied from a boost-type switching converter, a charge pump or the like. Therefore, by adjusting those boost ratio in accordance with the signal level of the signal Dout, the anode voltage of the light emitting diode may be increased.

Herein, when the voltage Vg13 is less than the voltage Vg17, according to the above formula (18), the maximum voltage of the voltage Vgs1 is 1.3 V. In this case, Vds13=Vdd1−Vgs1=3.2 V−1.3 V=1.9 V and Vgs13−Vthn=Vov13=0.3 V to 0.7 V are obtained. Therefore, the above formula (15) is expressed as Vds13=1.9 V≥Vgs13−Vthn=0.3 V to 0.7 V, which shows that the magnitude relationship is correct.

Figure 4:
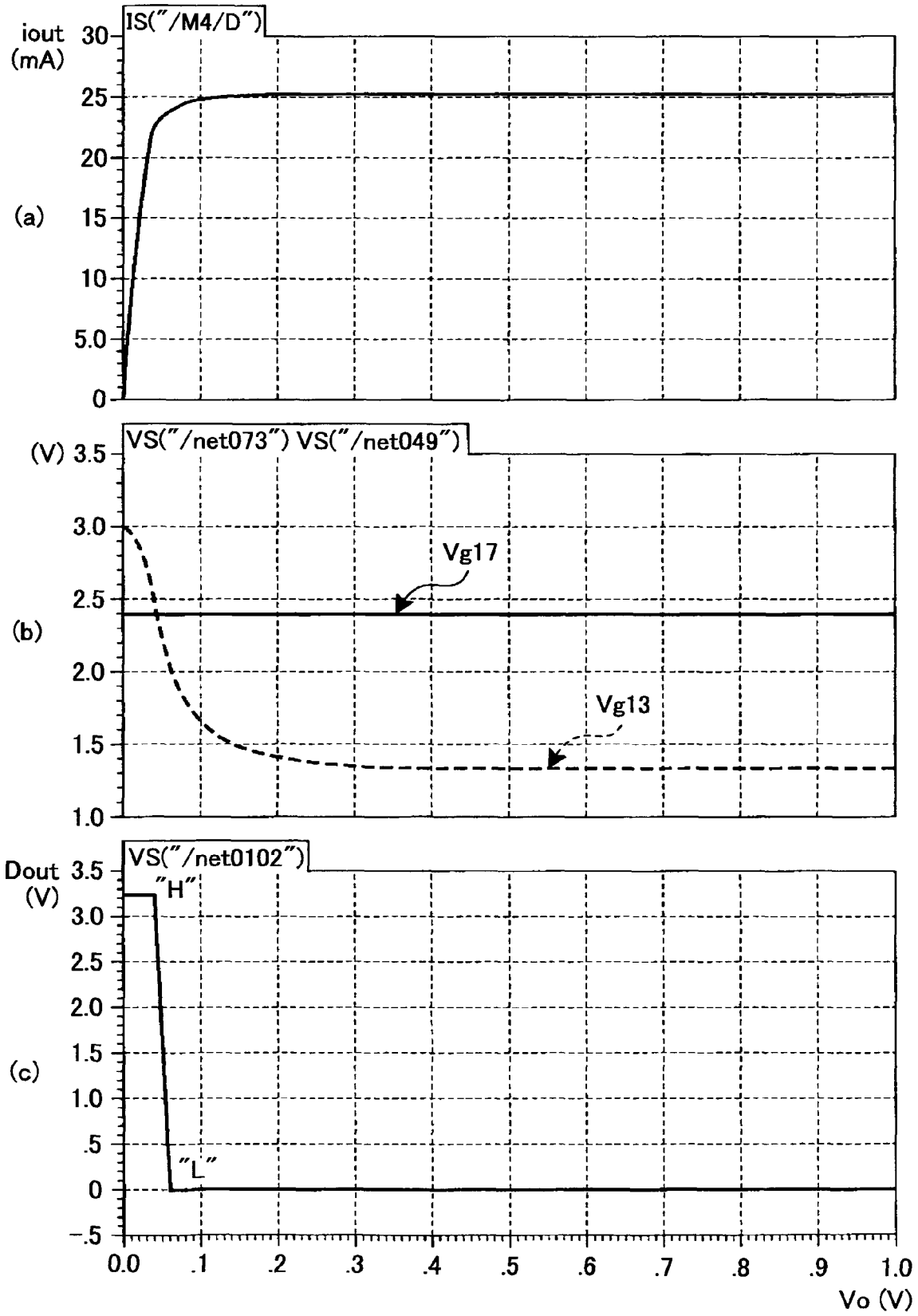
FIG. 4 illustrates characteristic diagrams of an operation example in the constant current circuit 1 of FIG. 1.

FIG. 4 illustrates simulation results when the above parameters are used. The lateral axis indicates the voltage Vo at the output terminal OUT in each of parts (a) through (c) of FIG. 4.

As indicated in FIG. 4, when the voltage Vg13 is greater than the voltage Vg17, the output signal Dout of the detection circuit 5 is converted from a low level (L) to a high level (H). At that timing, the voltage Vo at the output terminal OUT is 0.05 V, and the constant current circuit 1 outputs the output current iout having a predetermined current value.

Therefore, according to formula (10), the conditions where the output current accuracy of the constant current circuit 1 can be maintained are expressed in the following formula (19).

$$0.05\ \text{V} \le \text{Vds2} \le 1.9\ \text{V} \tag{19}$$

Figure 10:
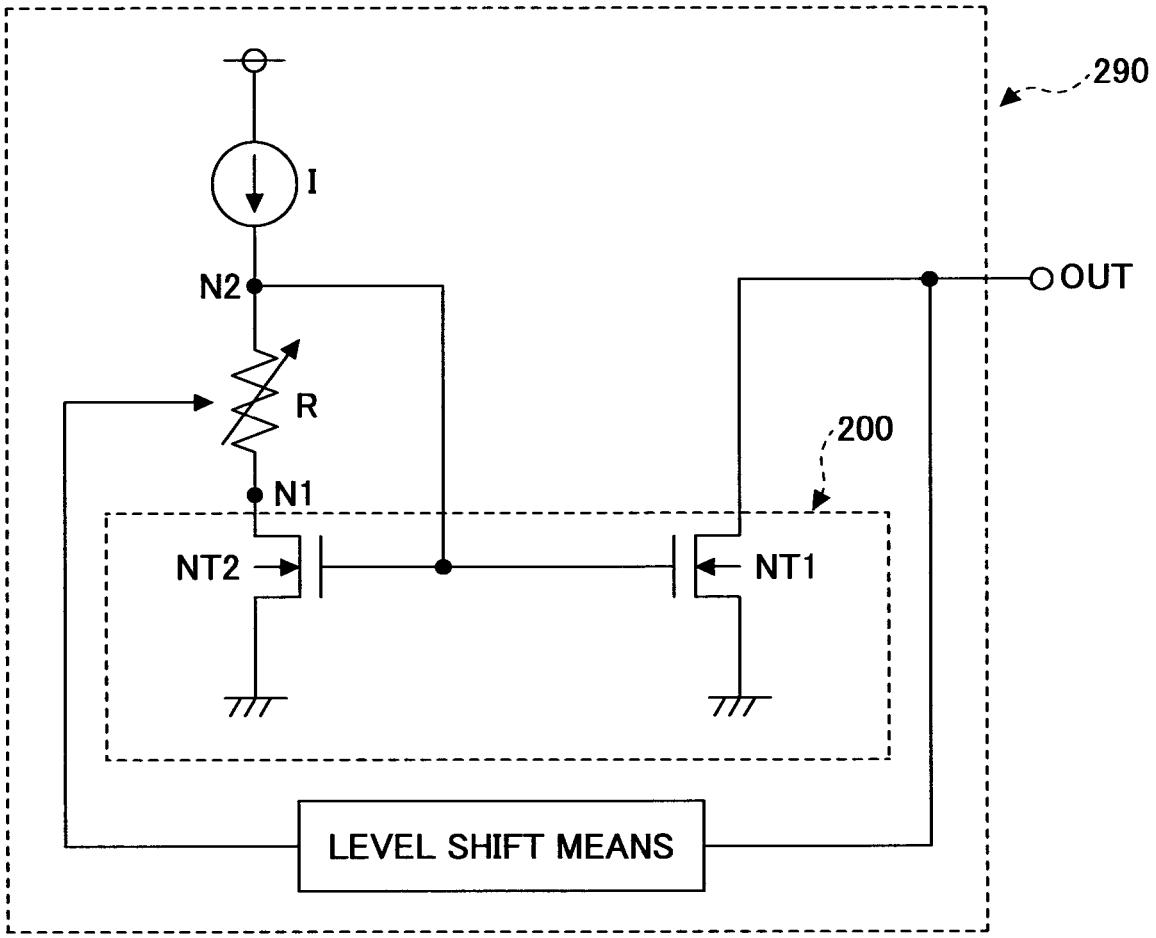
FIG. 10 is a circuit diagram of another example of a conventional constant current circuit.

On the other hand, in a conventional example 2 illustrated in FIG. 10, when assuming that Vthn=0.8 V and Vov=0.3 V, the conditions where the output current accuracy of the constant current circuit can be maintained are Vo≤1.1 V, and the minimum terminal voltage for the output transistor to operate in the saturation region is Vo≥0.3 V. Namely, the output current accuracy may be maintained in a range satisfying the formula (20).

$$0.3\ \text{V} \le \text{Vds2} \le 1.1\text{V} \tag{20}$$

Figure 11:
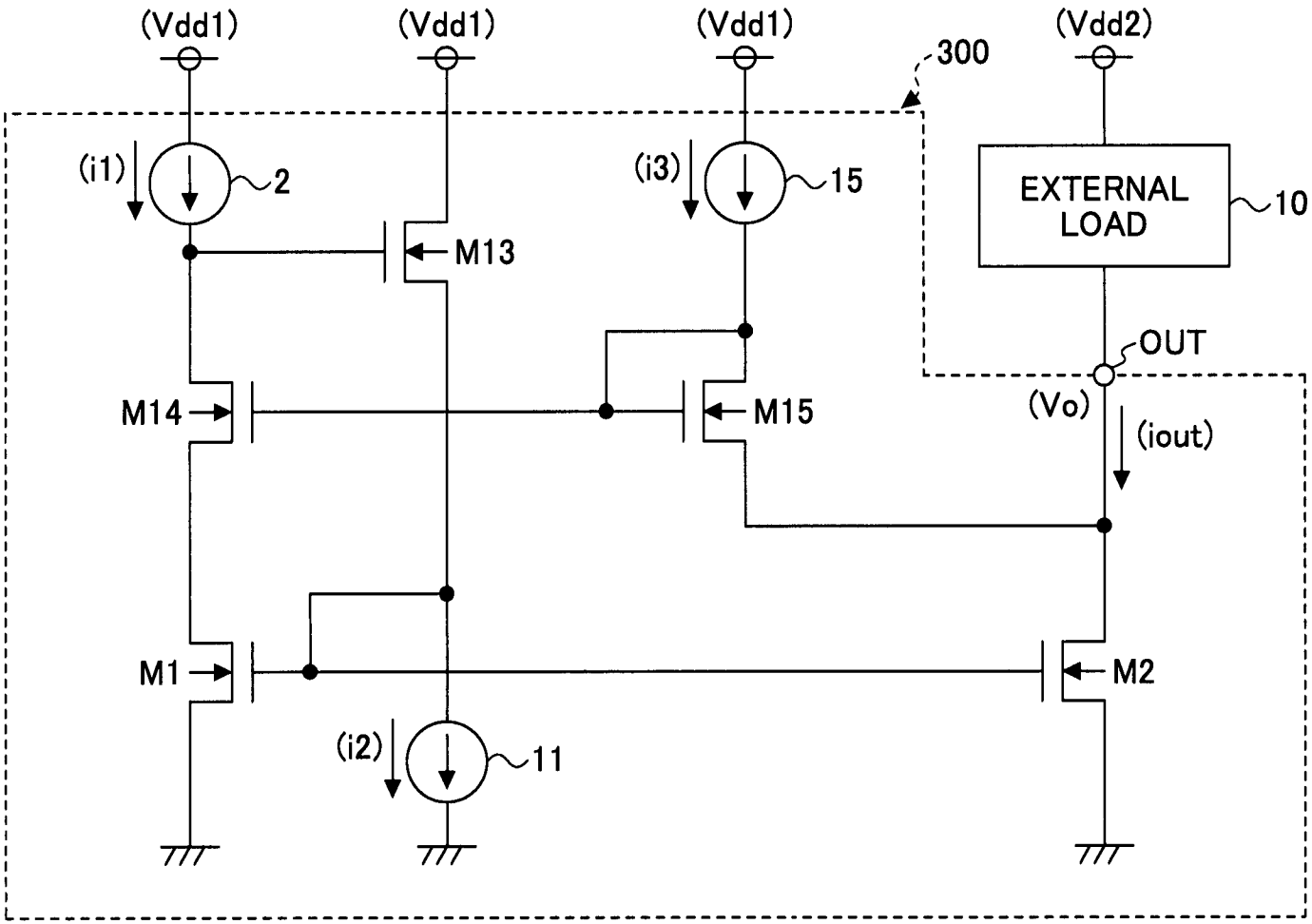
FIG. 11 is a circuit diagram of another example of a conventional constant current circuit.

In the same manner, in a conventional example 3 illustrated in FIG. 11, the conditions where the output current accuracy of the constant current circuit can be maintained are expressed in the following formula (21).

$$0.3\ \text{V} \le \text{Vds2} \le 1.9\text{V} \tag{21}$$

Figure 5:
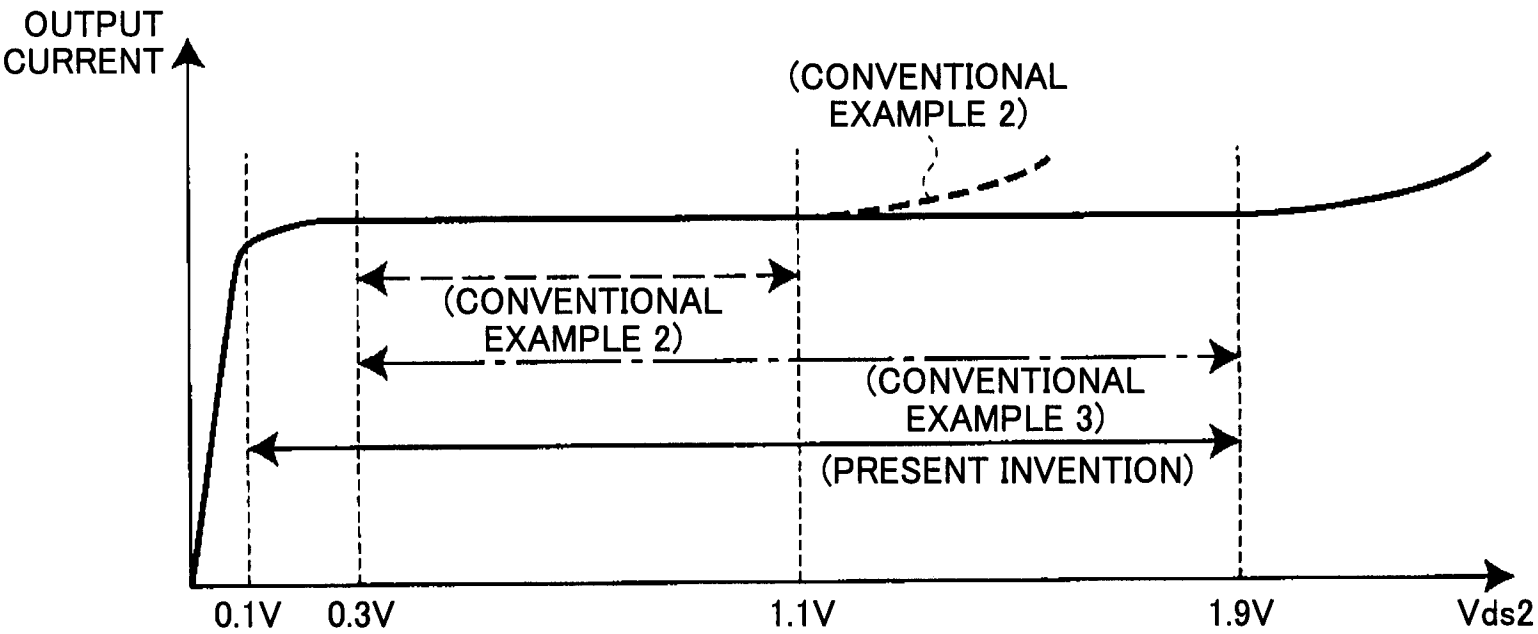
FIG. 5 is a drawing illustrating characteristics of the output current of the constant current circuit 1 of FIG. 1.

FIG. 5 illustrates a characteristics example of the output current in considerations of the conditions of formulas (19) through (21).

As apparent from FIG. 5, in the conventional examples 2 and 3, the minimum value of the voltage Vds2 where the output current accuracy can be maintained is 0.3 V. On the other hand, according to this embodiment of the present invention, the minimum value of the voltage Vds2 where the output current accuracy can be maintained is greatly reduced to 0.05 V.

Further, in the NMOS transistor M17, the current amplification degree β is denoted by β17, the overdrive voltage Vov17 is expressed as follows:

$$\text{Vov17}=(2\times i5/\beta 17)^{1/2}$$

Since i5 and β17 may be arbitrarily set, when assuming that Vthn17=0.8 V and Vov17=0.5 V, it is expressed that Vgs17=Vthn17+Vov17=0.8 V+0.5 V=1.3 V. Therefore, the formula (16) is expressed as in the following formula (22).

$$2.9\ \text{V} \ge \text{Vgs17}+1.1\ \text{V}=2.4\ \text{V} \ge \text{Vgs13}+\text{Vgs1} \tag{22}$$

Similar to formula (17), formula (18) may be derived from formula (22). Therefore, similar effects may be obtained.

As described above, the constant current circuit according to the first embodiment of the present invention includes the detection circuit 5 that detects a state that while at least one of the NMOS transistors M1 and M2 operates in the linear region, at least one of the NMOS transistors M1 and M2 becomes unable to output a current proportional to a constant current i1 from the constant current source 2. By having this configuration, it may become possible to substantially expand the operating voltage range at the output terminal where highly-accurate output current is output and greatly improve the efficiency as well.

Figure 9:
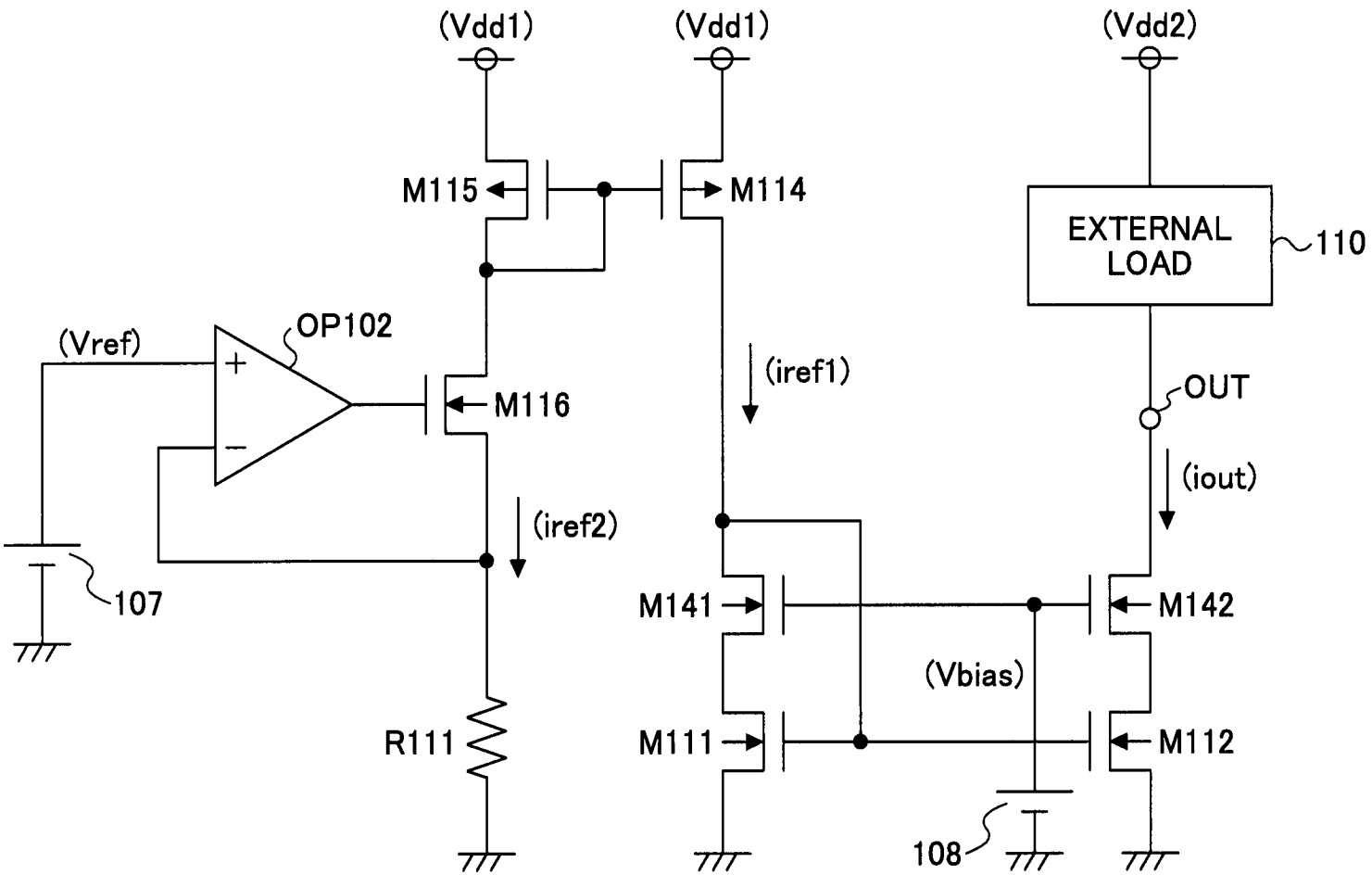
FIG. 9 is a circuit diagram of an example of a conventional constant current circuit.

Further, it may become possible to remove the NMOS transistors M141 and M142 of FIG. 9 corresponding to the cascode element in related art. Because of this feature, it may become possible to greatly reduce the chip area and output a highly-accurate output current without generating a systematic error due to the voltage change at the output terminal OUT. Further, it may become possible to reduce the power consumption consumed by the output transistor by reducing the minimum voltage at the output terminal OUT by half, substantially expand the voltage range at the output terminal where highly-accurate output current can be output, and obtain far greater versatility.

Figure 6:
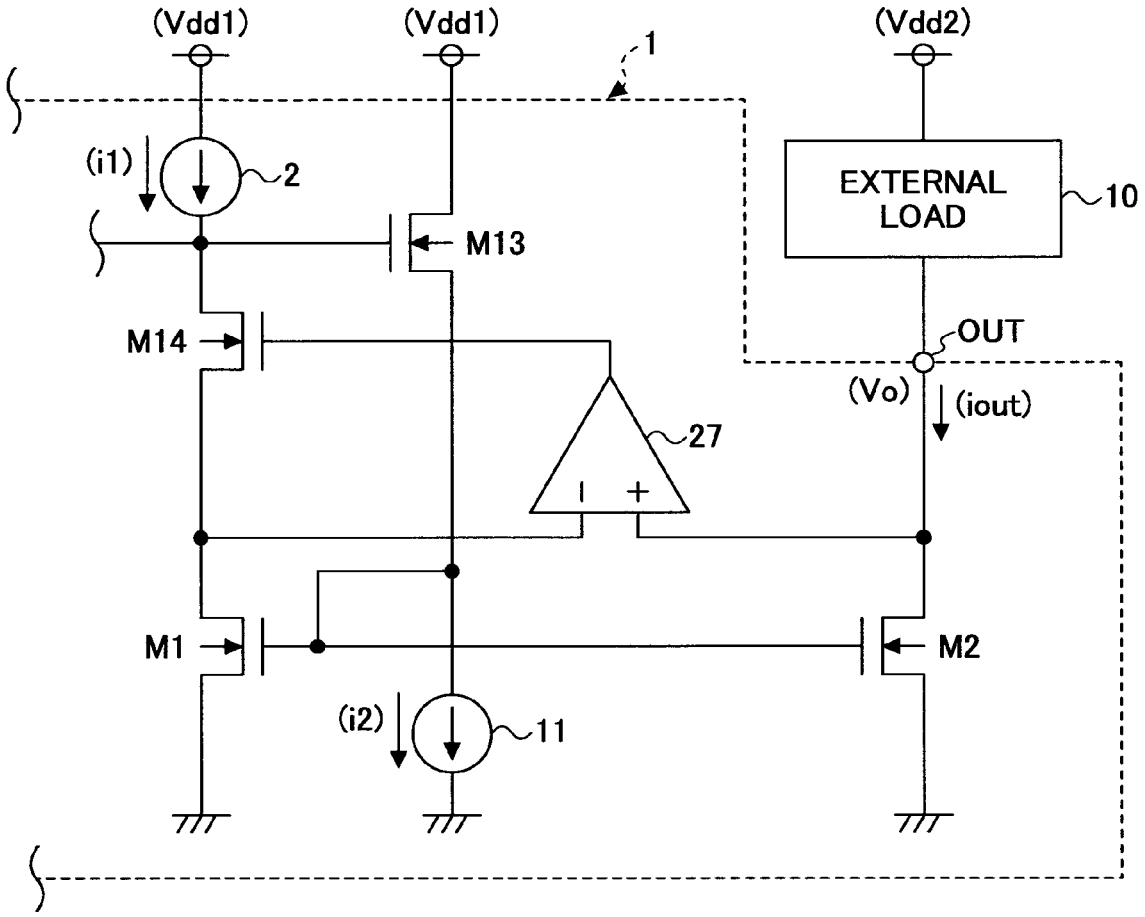
FIG. 6 is a drawing illustrating another example of the constant current circuit 1 of FIG. 1.

Further, in FIG. 2, the constant current source 15 and the NMOS transistor M15 may be removed and an error amplification circuit 27 may be used. In this case, as illustrated in FIG. 6, the output terminal of the error amplification circuit 27 is connected to the gate of the NMOS transistor M14, the inverting input terminal of the error amplification circuit 27 is connected to the connecting section between the NMOS transistor M14 and the NMOS transistor M1, and the non-inverting input terminal of the error amplification circuit 27 is connected to the output terminal OUT.

By doing this, the error amplification circuit 27 controls the gate voltage of the NMOS transistor M14 so that the drain voltage Vd1 of the NMOS transistor M1 is equal to the drain voltage Vd2 of the NMOS transistor M2. As a result a state Vd1=Vd2 is obtained.

In this case, when the gate voltage, the drain voltage, and the source voltage of the NMOS transistor M1 are equal to the gate voltage, the drain voltage, and the source voltage, respectively, of the NMOS transistor M2, it may become possible for the NMOS transistor M2 to accurately output the current determined based on the transistor size ratio between the NMOS transistors M1 and M2 without suffering an influence of λ characteristics. As described above, due to the negative feedback control provided by the error amplification circuit 27, it may become possible to accurately set the drain voltage of the NMOS transistor M2 to be equal to the drain voltage of the NMOS transistor M1.

Figure 7:
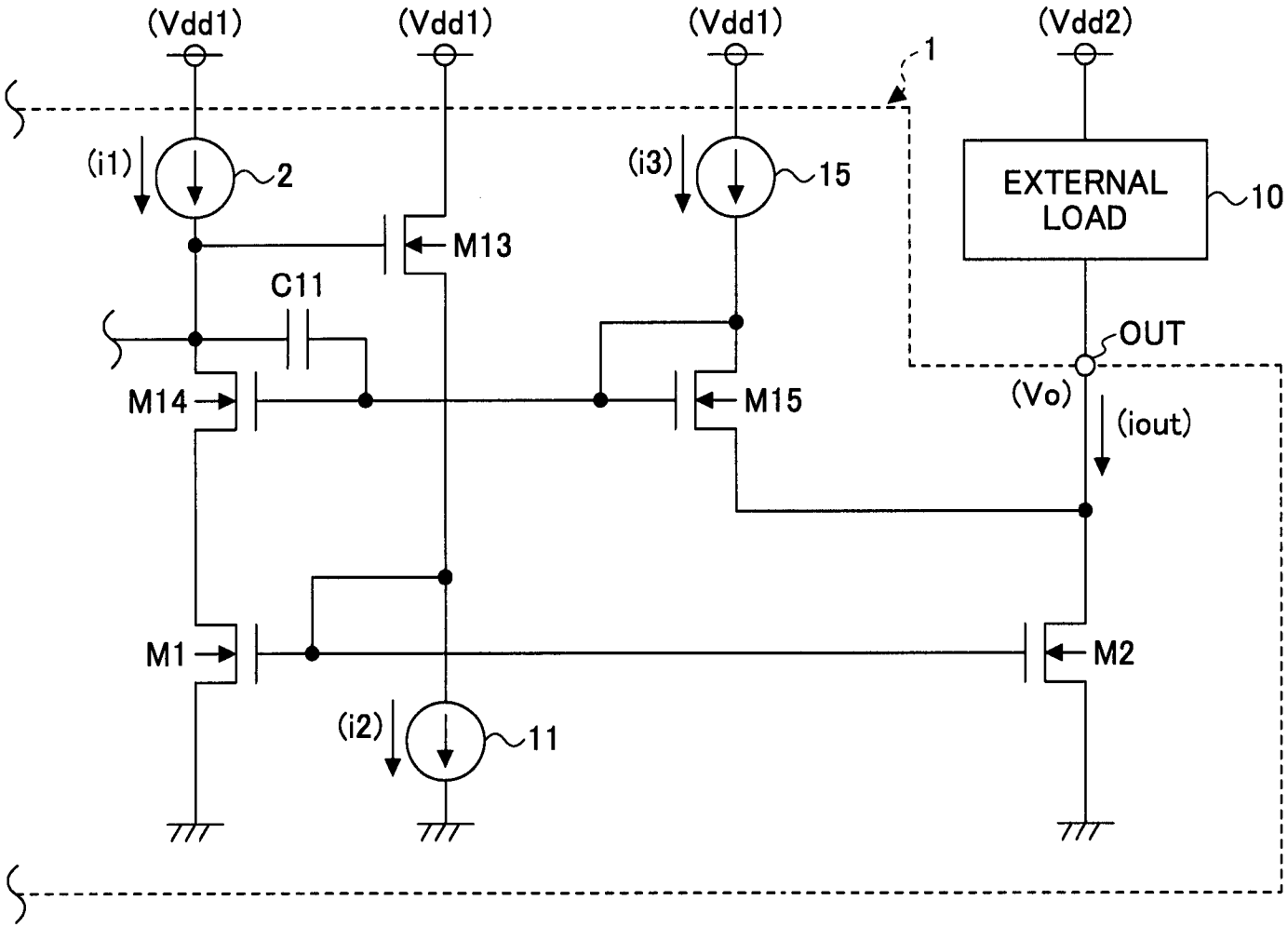
FIG. 7 is a drawing illustrating another example of the constant current circuit 1 of FIG. 1.

Further in FIG. 2, after the operation of the circuit is started up or after the current value of the constant current i1 is changed, due to the sudden change of the gate voltage of the NMOS transistor M13, overshoot or undershoot may occur in the output current iout. Therefore, the occurrence of the overshoot and the undershoot may be prevented. To that end, as illustrated in FIG. 7, a capacitor C11 may be added between the drain and the gate of the NMOS transistor M14. By doing this, the same effects as those in the first embodiment may be obtained and the occurrence of the overshoot and the undershoot in the output current iout may be prevented as well. As a result, it may become possible to prevent a failure without supplying an overcurrent to the external load 10.

Further, in FIG. 7, a case is illustrated based on the circuit configuration of FIG. 2. However, the modification as illustrated in FIG. 7 may also be applied to the circuit configuration of FIG. 6.

Further, in FIG. 2, due to dispersion in manufacturing or the like, there may be a case such that the drain voltage of the NMOS transistor M1 is controlled to be less than the drain voltage of the NMOS transistor M2, the drain voltage of the NMOS transistor M2 is lowered, so that the NMOS transistor M1 operates in the linear region. Thus, the gate voltage of the NMOS transistor M1 is greatly increased in order to flow the constant current i1 to the NMOS transistor M1. In this case, if the drain voltage of the NMOS transistor M2 is greater than the drain voltage of the NMOS transistor M1 and the NMOS transistor M2 operates in the saturation region, an erroneous operation of outputting the output current greater than the set current value may occur.

Figure 8:
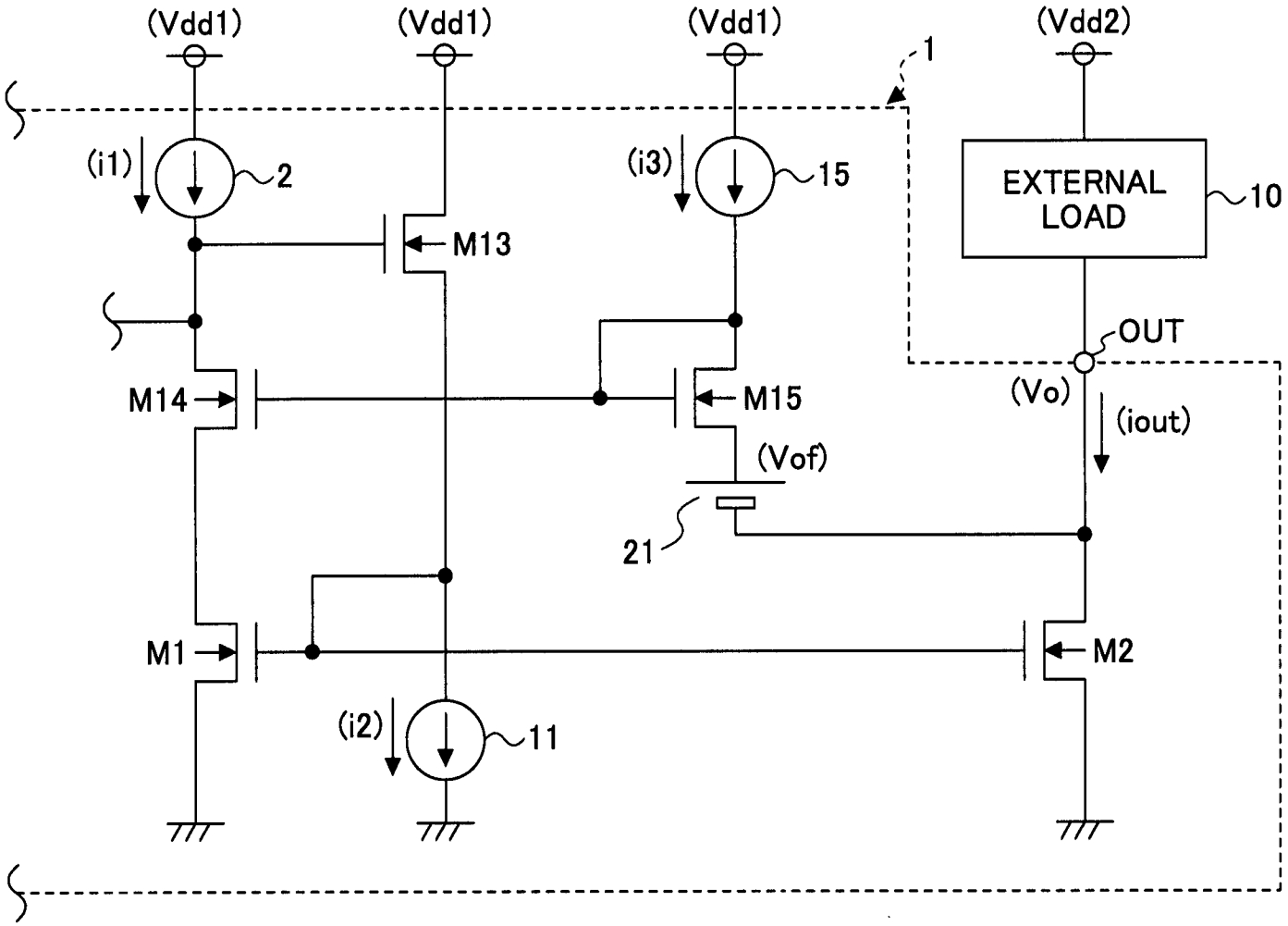
FIG. 8 is a drawing illustrating another example of the constant current circuit 1 of FIG. 1.

To prevent such an erroneous operation, as illustrated in FIG. 8, an offset voltage generation circuit 21 may be provided that applies a voltage to the source of the NMOS transistor M15, the voltage being obtained by adding a predetermined offset voltage Vof to the drain voltage of the NMOS transistor M2. By doing this, the offset voltage Vof may be provided between the gate and the source of the NMOS transistors M14 and M15. Therefore, the drain voltage of the NMOS transistor M1 is controlled to be greater than the drain voltage of the NMOS transistor M2 by the offset voltage Vof.

Further, with reference to FIG. 8, a case is described where the offset voltage generation circuit 21 is provided. However, without providing the offset voltage generation circuit 21, by, for example, changing the transistor size of the NMOS transistors M14 and M15, the characteristics of the NMOS transistors M14 and M15 may be changed, so that the offset voltage Vof is generated.

By doing this, the same effects as those in the first embodiment may be obtained and the occurrence of erroneous operation of outputting an output current greater than the set current value due to the dispersion in manufacturing may be prevented as well.

Further, in FIG. 8, a case is illustrated based on the circuit configuration of FIG. 2. However, by providing the input offset voltage to the error amplification circuit 27 in FIG. 6, the same effect as that obtained in FIG. 8 may be obtained. Further, the constant current circuit illustrated in FIG. 8 may also be applied to the constant current circuit having the configuration illustrated in FIG. 7. In this case, the capacitor C11 may be provided between the drain and the gate of the NMOS transistor M14 in the constant current circuit of FIG. 8.

Further, in the above description, the power-supply voltage Vdd1 may be equal to or different from the power-supply voltage Vdd2. Further, the constant current circuit 1 may be integrated into a single IC along with at least one of a power supply circuit generating the power-supply voltage Vdd1 and a power supply circuit generating the power-supply voltage Vdd2. In this case, the external load 10 may be integrated into a single IC along with the constant current circuit 1.

Further, in the above description, a case is described where the NMOS transistors are used in the output transistor. However, the present invention is not limited to this configuration. The present invention may also be applied to a case where PMOS transistors are used in the output transistor.

The present application is based on and claims the benefit of priority of Japanese Patent Application No. 2010-147982, filed on Jun. 29, 2010, the entire contents of which are hereby incorporated herein by reference.

The invention claimed is:

1. A constant current circuit that generates a predetermined constant current and supplies the predetermined constant current to a load, the constant current circuit comprising:

a first transistor composed of a MOS transistor that flows a current in accordance with a control signal input to the gate of the first transistor;

a second transistor composed of a MOS transistor having a same conductivity type as that of the first transistor, the gate and the source of the second transistor corresponding to and being connected to the gate and the source, respectively, of the first transistor, the drain of the second transistor being connected to the load, the second transistor supplying a current to the load, the current being in accordance with the control signal input to the gate of the second transistor;

a voltage adjustment circuit section that controls the drain voltage of the first transistor in accordance with the drain voltage of the second transistor;

a constant current generation circuit section that is composed of a first current source that supplies a predetermined first constant current to the first transistor via the voltage adjustment circuit section;

a level shift circuit section that level-shifts a voltage of a connecting section between the voltage adjustment circuit section and the constant current generation circuit section and that outputs the level-shifted voltage to the gates of the first transistor and the second transistor; and a detection circuit section that determines whether at least one of the first transistor and the second transistor is unable to output a current proportional to the first constant current while at least one of the first transistor and the second transistor operates in the linear region, wherein the detection circuit section determines by performing a voltage comparison between a voltage at the connecting section between the voltage adjustment circuit section and the constant current generation circuit section and a predetermined reference voltage, wherein the detection circuit section generates a fourth constant current having a same current value as that of the first constant current, supplies the fourth constant current to a sixth transistor having a same conductivity type as that of the first transistor, and sets a voltage of an input terminal of the sixth transistor as the reference voltage, the voltage being obtained by level-shifting the voltage of the input terminal of sixth transistor, the fourth constant current being input to the input terminal, and inputting the level-shifted voltage to the gate of the sixth transistor.

2. The constant current circuit according to claim 1, wherein the level shift circuit section includes:

a third transistor composed of a MOS transistor and having a gate connected to the connecting section between the voltage adjustment circuit section and the constant current generation circuit section and a second constant current source that supplies a predetermined second constant current to the third transistor, and the third transistor and the second constant current source form a source follower circuit, and a connecting section between the third transistor and the second constant current source is connected to the gates of the first transistor and the second transistor, so that the level shift circuit section level-shifts the voltage of the connecting section between the voltage adjustment circuit section and the constant current generation circuit section by the gate-source voltage of the third transistor.

3. The constant current circuit according to claim 2, wherein the detection circuit section includes:

the sixth transistor composed of a MOS transistor that flows a current in accordance with a control signal input to the gate of the sixth transistor, a fourth current source that supplies a predetermined fourth constant current to the sixth transistor, a level shift circuit that level-shifts a voltage of a connecting section between the sixth transistor and the fourth current source and outputs the level-shifted voltage to the gate of the sixth transistor, and a voltage comparison circuit that performs a voltage comparison between the reference voltage and the voltage of the connecting section between the voltage adjustment circuit section and the constant current generation circuit section, the reference voltage being the voltage of the connecting section between the sixth transistor and the fourth current source, and that generates and outputs a signal indicating a result of the voltage comparison.

4. The constant current circuit according to claim 3, wherein the level shift circuit includes:

a seventh transistor that has the gate connected to a connecting section between the sixth transistor and the fourth current source and that is composed of a MOS transistor having a same conductivity type as that of the third transistor, and a fifth constant current source that supplies a predetermined fifth constant current to the seventh transistor, and the seventh transistor and the fifth constant current source form a source follower circuit, and a connecting section between the seventh transistor and the fifth constant current source is connected to the gate of the sixth transistor, so that the level shift circuit level-shifts the voltage of the connecting section between the seventh transistor and the fifth constant current source by the gate-source voltage of the seventh transistor.

5. The constant current circuit according to claim 4, wherein a current amplification factor of the seventh transistor is less than a current amplification factor of the third transistor.

6. The constant current circuit according to claim 4, wherein a threshold value of the seventh transistor is greater than the threshold value of the third transistor.

7. The constant current circuit according to claim 4, wherein the fifth constant current source generates the fifth constant current having a current value greater than the current value of the second constant current.

8. The constant current circuit according to claim 1, wherein the voltage adjustment circuit section includes:

a fourth transistor that is connected between the constant current generation circuit section and the first transistor and that is composed of a MOS transistor, a fifth transistor having a terminal connected to the drain of the second transistor, having the gate connected to the gate of the fourth transistor, and composed of a MOS transistor having a same conductivity type as that of the fourth transistor, and a third constant current source that supplies a predetermined third constant current to the other terminal of the fifth transistor, and a connecting section between the gates of the fourth transistor and the fifth transistor is connected to a connecting section between the third constant current source and the fifth transistor, and an operation of the fourth transistor is controlled so that the drain voltage of the first transistor is equal to the drain voltage of the second transistor.

9. The constant current circuit according to claim 8, wherein the first constant current and the third constant current are set in a manner such that a value of a current ratio between the first constant current and the third constant is equal to a value of a ratio between a current amplification degree of the fourth transistor and a current amplification degree of the fifth transistor.

10. The constant current circuit according to claim 8, wherein the fourth transistor has a same conductivity type and a same size as those of the first transistor.

11. The constant current circuit according to claim 1, wherein the voltage adjustment circuit section includes:

a fourth transistor that is connected between the constant current generation circuit section and the first transistor and that is composed of a MOS transistor, a voltage generation circuit that generates a voltage obtained by adding a predetermined voltage to the drain voltage of the second transistor, a fifth transistor having a terminal to which the voltage generated by the voltage generation circuit is input, having the gate connected to the gate of the fourth transistor, and composed of a MOS transistor having a same conductivity type as that of the fourth transistor, and a third constant current source that supplies a predetermined third constant current to the other terminal of the fifth transistor, and a connecting section between the gates of the fourth transistor and the fifth transistor is connected to a connecting section between the third constant current source and the fifth transistor, and an operation of the fourth transistor is controlled so that the drain voltage of the first transistor is greater than the drain voltage of the second transistor by the predetermined voltage.

12. The constant current circuit according to claim 1, wherein the voltage adjustment circuit section includes:

a fourth transistor that is connected between the constant current generation circuit section and the first transistor and that is composed of a MOS transistor, a fifth transistor having a terminal connected to the drain of the second transistor, having the gate connected to the gate of the fourth transistor, and composed of a MOS transistor having a same conductivity type as that of the fourth transistor, and a third constant current source that supplies a predetermined third constant current to the other terminal of the fifth transistor, and a connecting section between the gates of the fourth transistor and the fifth transistor is connected to a connecting section between the third constant current source and the fifth transistor, and an operation of the fourth transistor is controlled so that the drain voltage of the first transistor is greater than the drain voltage of the second transistor by a predetermined voltage.

13. The constant current circuit according to claim 1, wherein the voltage adjustment circuit section includes:

a comparison circuit that performs a voltage comparison between the drain voltage of the first transistor and the drain voltage of the second transistor and that generates and outputs a signal indicating a result of the voltage comparison, and a voltage adjustment circuit that controls the drain voltage of the first transistor in accordance with the drain voltage of the second transistor based on the signal indicating the result of the voltage comparison, and the comparison circuit is composed of an error amplification circuit having input terminals to which the drain voltages of the first transistor and the second transistor are input, respectively, and the voltage adjustment circuit includes the gate to which an output signal from the error amplification circuit is input and is composed of a fourth transistor that is connected to the drain of the first transistor in series and that is composed of a MOS transistor.

14. The constant current circuit according to claim 13, wherein the fourth transistor is a transistor having a same conductivity type as that of the first transistor, and the error amplification circuit controls an operation of the fourth transistor so that the drain voltage of the first transistor is equal to the drain voltage of the second transistor.

15. The constant current circuit according to claim 13, wherein the fourth transistor is a transistor having a same conductivity type as that of the first transistor, and the error amplification circuit provides a predetermined input offset voltage so that the drain voltage of the first transistor is greater than the drain voltage of the second transistor by a predetermined voltage.

16. The constant current circuit according to claim 8, wherein the voltage adjustment circuit section further includes a capacitor connected between a connecting section and the gate of the fourth transistor, the connecting section being between the fourth transistor and the constant current generation circuit section.

17. The constant current circuit according to claim 1, wherein the first transistor, the second transistor, the voltage adjustment circuit section, the constant current generation circuit section, the level shift circuit section, and the detection circuit section are integrated into a single IC.

18. A light emitting diode driving device comprising:

a constant current circuit according to claim 1 that generates a predetermined constant current and supplies the generated current to a light emitting diode.

* * * * *